US006132038A

United States Patent [19]

Szlucha

[11] Patent Number: 6,132,038

[45] Date of Patent: Oct. 17, 2000

[54] LIQUID INK PRINTER HAVING A SELF REGULATING CONTACT DRIER

[75] Inventor: Thomas F. Szlucha, Fairport, N.Y.

[73] Assignee: Xerox Corporation, Stamford, Conn.

[21] Appl. No.: 08/922,013

[22] Filed: Sep. 2, 1997

[51] Int. Cl.[7] ..... B41J 2/01

[52] U.S. Cl. ..... 347/102

[58] Field of Search ..... 347/101, 102, 347/155, 187, 212

[56] References Cited

U.S. PATENT DOCUMENTS

| | | | |
|---|---|---|---|
| 4,970,528 | 11/1990 | Beaufort et al. . | |
| 5,005,025 | 4/1991 | Miyakawa et al. . | |
| 5,274,400 | 12/1993 | Johnson et al. . | |
| 5,287,123 | 2/1994 | Medin et al. . | |
| 5,329,295 | 7/1994 | Medin et al. | 347/102 X |
| 5,500,667 | 3/1996 | Schwiebert et al. | 347/102 |
| 5,691,756 | 11/1997 | Rise et al. | 347/102 |
| 5,742,315 | 4/1998 | Szlucha et al. | 347/102 |
| 5,831,655 | 11/1998 | Asawa et al. | 347/102 |
| 5,896,154 | 4/1999 | Mitani et al. | 347/102 |

*Primary Examiner*—Sandra Brase

[57] ABSTRACT

A liquid ink printer for depositing liquid ink to form an image on a recording medium moving along a path including a contact heater and a printhead. The printhead, disposed adjacent to the path, is adapted to deposit ink on the recording medium in a print zone including a dimension being defined by the printhead. The contact heater, disposed adjacently to the path, includes a positive temperature coefficient material, generating heat energy for heating the recording medium. In one embodiment, the positive coefficient material comprises a doped ceramic material. A first portion of the heater is disposed substantially opposite said printhead and a second portion is disposed at a position located before the printhead along the path direction.

15 Claims, 4 Drawing Sheets

LIQUID INK PRINTER HAVING A SELF REGULATING CONTACT DRIER

FIELD OF THE INVENTION

This invention relates generally to a liquid ink printing machine and more particularly to a liquid ink printer having a self regulating contact drier.

BACKGROUND OF THE INVENTION

Liquid ink printers of the type frequently referred to as continuous stream or as drop-on-demand, such as piezoelectric, acoustic, phase change wax-based or thermal, include at least one printhead having drop ejectors from which droplets of ink are directed towards a recording sheet. Within the printhead, the ink is contained in a plurality of channels. Power pulses cause the droplets of ink to be expelled as required from orifices or nozzles at the end of the channels.

In a thermal ink-jet printer, the power pulses are usually produced by resistors, each located in a respective one of the channels, which are individually addressable to heat and vaporize ink in the channels. As voltage is applied across a selected resistor, a vapor bubble grows in the associated channel and initially the ink bulges from the channel orifice. The bubble quickly collapses and the ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has one or more relatively small printheads containing the ink channels and nozzles. The printheads can be sealingly attached to one or more disposable ink supply cartridges and the combined printheads and cartridge assembly is attached to a carriage which is reciprocated to print one swath of information (equal to the length of a column of nozzles), at a time, on a stationary recording medium, such as paper or a transparency. After the swath is printed, the paper can be stepped a distance equal to the height of the printed swath or a portion thereof, so that the next printed swath is contiguous or overlapping therewith. This procedure is repeated until the entire page is printed.

In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks and particularly those used in thermal ink jet printing, include a colorant or dye and a liquid which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning of the recording medium typically prepares the recording medium for receiving ink by driving out excess moisture which can be present in a recording medium such as paper. Not only does this preconditioning step reduce the amount of time necessary to dry the ink once deposited on the recording medium, but this step also improves image quality by reducing paper cockle and curl which can result from too much moisture remaining in the recording medium.

Various drying mechanisms for drying images deposited on recording mediums are illustrated and described in the following disclosures which may be relevant to certain aspects of the present invention.

In U.S. Pat. No. 4,970,528 to Beaufort et al., a method for uniformly drying ink on paper from an ink jet printer is described. The printer includes a uniform heat flux dryer system including a 180° contoured paper transport path for transferring paper from an input supply tray to an output tray. During transport, the paper receives a uniform heat flux from an infrared bulb located at the axis of symmetry of the paper transport path. Reflectors are positioned on each side of the infrared bulb to maximize heat transmission from the bulb to the paper during the ink drying process.

U.S. Pat. No. 5,005,025 to Miyakawa et al. describes an ink jet recording apparatus including a heating member extending both upstream and downstream with respect to a recording area. The heating member contacts the recording sheet to assist in the fixation of the ink.

U.S. Pat. No. 5,274,400 to Johnson et al., describes an ink path geometry for high temperature operation of ink jet printheads. A heating means is positioned close to a print zone for drying of the print medium. The heating means includes a print heater and a reflector which serve to concentrate the heat on the bottom of the print medium through a screen.

U.S. Pat. No. 5,287,123 to Medin et al., describes a color ink jet printer having a heating blower system for evaporating ink carriers from the print medium after ink-jet printing. A print heater halogen quartz bulb heats the underside of the medium via radiant and convective heat transfer through an opening pattern formed in a print zone heater screen.

U.S. Pat. No. 5,500,667 to Schwiebert et al. describes a method and apparatus for heating the print medium in an ink jet printer to reduce printing defects in a relatively cold machine. The printer includes a print area heater which in a steady state condition for a given print medium is energized at a first heating level.

SUMMARY OF THE INVENTION

In accordance with one aspect of the present invention, there is provided a liquid ink printer for depositing liquid ink to form an image on a recording medium moving along a path. The printer includes a printhead, disposed adjacent to the path, adapted to deposit ink on the recording medium in a print zone including a dimension being defined by the printhead, and a contact heater, disposed adjacently to the path, including a positive temperature coefficient material, generating heat energy for heating the recording medium.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Although the present invention discussed herein may be used for drying any image which is created by a liquid ink printer, the description of the present invention will be described in the environment of an ink jet printer such as that shown in FIG. 1.

Figure 1:
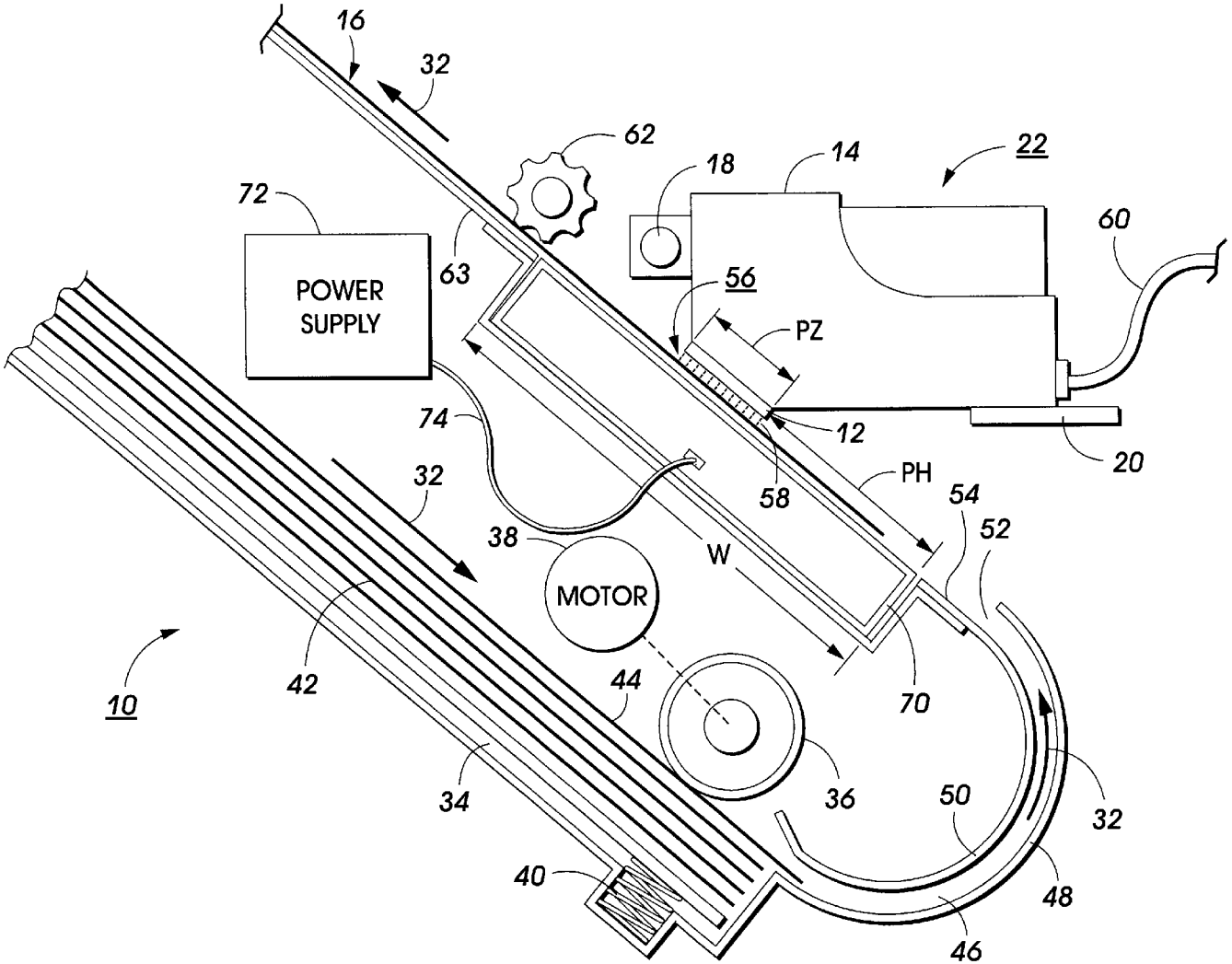
FIG. 1 illustrates a schematic side elevational view of a liquid ink printer having a self regulating contact dryer.
Figure 3:
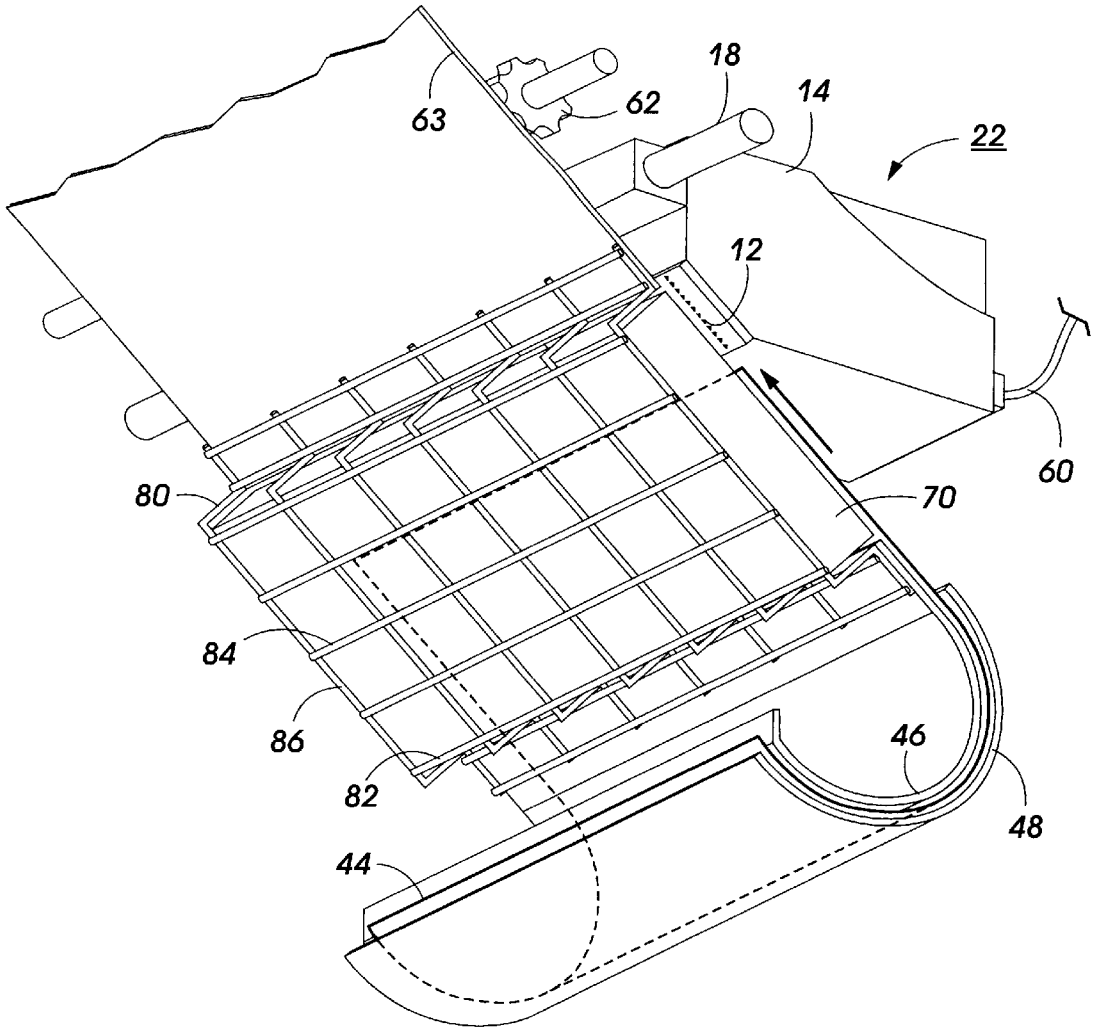
FIG. 3. illustrates a schematic elevational view of the underneath side of the liquid ink printer of FIG. 1.

FIG. 1 illustrates a schematic representation of a thermal ink jet printer 10 in a side elevation view. A translating ink jet printhead 12 depositing black and/or colored ink drops through a plurality of nozzles is supported by a housing 14 which moves back and fourth across a recording medium 16, for instance, a sheet of transparencies or paper, on a guide rail 18 and a supporting shelf 20. Multiple printheads printing different colors are within the scope of this invention as well as a single printhead being segmented for printing different colors. The housing 14 supports a plurality of ink tanks 22, wherein the ink tanks include for instance black, cyan, magenta, and yellow inks. Each of these inks may be contained in a separate ink tank such as illustrated in FIG. 3, where a black ink tank 24, a cyan ink tank 26, a magenta ink tank 28, and a yellow ink tank 30 are illustrated.

The recording medium 16 is moved along a recording medium path 32 in the direction noted by the arrows 32. Single sheets of the recording medium are fed from a tray 34 by document feed roll 36 driven by a motor 38 under the control of a printer controller (not shown). The document tray 34 is spring biased by biasing mechanism 40 which forces the top sheet of a stack of recording sheets 42 into contact with the feed roller 36. A top most recording medium 44, in contact with the drive roller 36, is transported by the drive roll into a chute 46 which is located between and defined by an outer guide member 48 and an inner guide member 50, each of which are curved such that the recording sheets reverse direction and are positioned in a reverse bow such that the sheets exit the chute 46 at an exit location 52. Once the recording medium exits the exit location 52, the reverse bow drives the leading edge of the recording sheet onto a platen 54 thereby generating a sufficient force to cause the recording sheet to lie flat thereon. It is also possible to locate a drive roll cooperating with a pinch roll at the exit location 52 to advance the recording sheet into a print zone 56, the length of which is defined by the length of the print head 12, here illustrated as PZ.

The print zone 56 includes the area directly beneath the printhead 12 where droplets of ink 58 are deposited by the array of ink nozzles which print a swath of information across the recording medium. The front face of the printhead 12 is substantially parallel to the recording medium. The housing 14, which travels orthogonally to the direction that the recording medium travels, deposits the ink droplets 58 upon the sheet in an image wise fashion. As illustrated, the printhead 12 receives ink from the plurality of ink tanks 22. It is also possible to supply ink to the print head 12 through a tube or a plurality of supply tubes attached to an ink supply located elsewhere in the printer.

The image deposited on the recording medium includes text and/or graphic images, the creation of which is controlled by the previously described controller as is known to those skilled in the art, in response to electrical signals transmitted through a cable 60 coupled to the printhead 12. A star wheel 62 or other known drive mechanism picks up the lead edge of the recording sheet at a support platen 63 and pulls the sheet past the printhead 12 once the sheet no longer is in contact with the drive roller 36 or other advancing mechanisms.

To fix the liquid ink to the recording sheets, the moisture must be driven from the ink as well as the recording medium. While it is possible to dry the ink by natural air drying, natural air drying can create certain problems such as cockles or curl and can also reduce the printing throughput of the printer. Consequently, active drying by the application of heat energy to the printed recording medium is preferred in many instances. To improve printing quality as well as to increase the printing throughput of the printer 10, the present invention includes a backside contact heater 70 which receives power from a power supply 72 coupled to the contact heater through a cable 74. The heater 70 is constructed of a positive temperature coefficient (PTC) material such as a PTC ceramic material. PTC paints are also known. In the present invention, such a paint would be painted on a supporting insulator, such as a ceramic insulator.

PTC ceramic materials are known and operate at a constant temperature because of a characteristic self temperature control function. Heaters of this kind have a structure in which a PTC ceramic material is sandwiched between a pair of electrode plates which is driven through the electrode plates with power supplied by the power supply. The electrode plates are thermally coupled indirectly or directly with radiating plates of the ceramic material through which the heat is generated.

As thermal ink jet technology progresses to higher printing speeds and to higher resolutions, one of the limiting parameters is the inability of the ink to sufficiently dry in a reasonable period of time to either prevent smearing during handling or to prevent image offsetting to the back of the next printed sheet. In applying thermal ink jet technology to a color printer, the drying problem is exacerbated by the tendency of the different colored inks to flow into one another when swaths of different color inks are printed adjacent to one another. This problem is referred to as inter-color bleed.

One known solution to these described drying problems has been to develop faster drying inks, ink formulations that are more quickly absorbed into the paper. Unfortunately, this approach trades off image quality, increased edge raggedness, and the back side of the image showing through from the increased leaking characteristics of the ink. In addition, absorbing high area coverage of ink leaves the recording sheets damp increasing the amount of stiffness lost in the sheet as well as developing cockles from the swell of the paper fibers in non-uniform areas. Other solutions include using an active dryer, that is applying heat energy to aide in the evaporation. Such known active dryers include radiant heat sources such as infrared lamps as well as resistive heating coils.

In contrast, the present invention using a PTC material offers a significant improvement over the conventional resistance heater design. Because the resistance of a PTC material increases as temperature increases, such materials are "self regulating". This means that as the PTC material becomes hotter, current flow is reduced until a steady-state temperature is reached. This enables the present heating device to maintain a relatively constant temperature and to automatically vary its power usage as a function of the load. In the present liquid ink printer design, such a heater would respond to increased drying requirements necessitated by high ink coverage and/or higher moisture content paper by increasing the power output, and therefore the heat energy, by attempting to maintain a constant temperature of the device itself. This self regulating feature also results in the elimination of the need for over-temperature safety protection devices. In addition, the present heater is relatively insensitive to normal variations in input voltage resulting from variations in the voltage supplied by the required power supply. Consequently, the PTC resistance material results in a very simple, cost effective design that eliminates a variety of costly temperature sensing and control components.

While the PTC ceramic materials include a variety of characteristics which are useful, the requirements of liquid ink drying are sufficiently rigid such that the temperatures generated by the heater 70, the dwell times over which the paper travels across a width W of the heater, the construction of the heater itself, and the support structure therefore are important aspects of the present invention.

The heater 70 includes a width W which is determined as a function of a print zone PZ defined by the printhead 12 and the printing swath of the printhead. The entire width W is also determined as a function of the print speed of the printer or how fast the paper moves past the printhead 12. The width of the heating zone, W, extends beyond the printer swath to allow for some preheating of the sheet prior to printing and to achieve a sufficient dwell time for adequate drying. Because of the relatively long dwell times involved, sufficient energy is transferred into the paper to evaporate a significant quantity of ink such that the portion which has been preheated includes a sufficient amount of inherent thermal energy for aiding in drying the liquid ink. In some applications where increased amounts of ink coverage or high area coverage and/or multiple color printing are present, it maybe desirable to make multiple passes of the print head over the same swath width allowing time for the previously deposited ink to dry. Dwell times of approximately five to forty-five seconds have been found to be acceptable.

Figure 2:
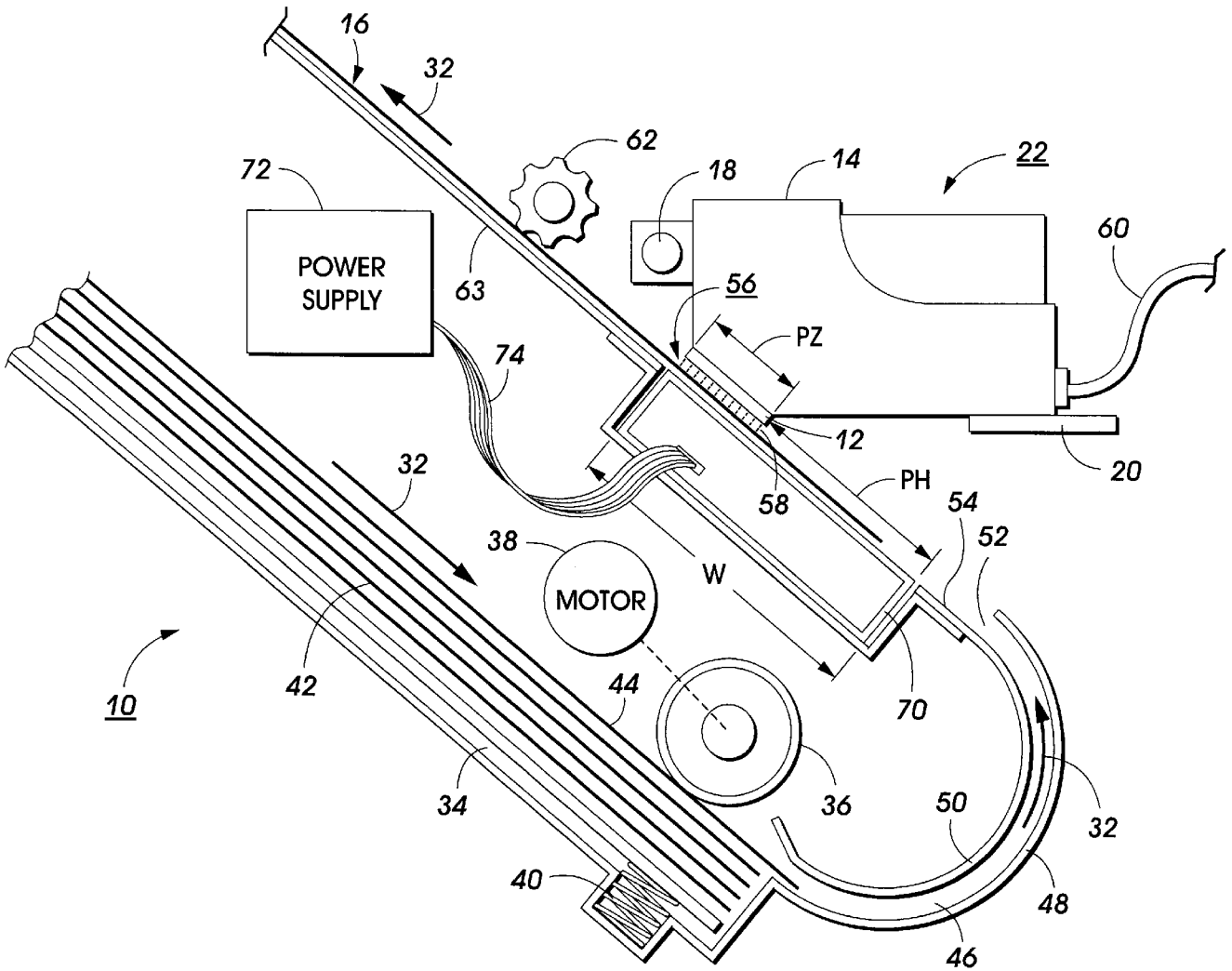
FIG. 2 illustrates a schematic side elevational view of an alternate embodiment of a liquid ink printer having a self-regulating contact dryer.

As an example and as illustrated in FIG. 2, in a printer printing at eight pages per minute, the width W of the ceramic heater is preferably at least approximately two and one half times the width of the print zone. In addition, a portion of the heater 70 is located before the print zone, also known as a preheat zone, having a width PH which in this particular embodiment is approximately one and one half times the width of the print zone PZ. By providing a preheat zone which is wider than the print zone, the portion of the recording medium directly preceding the print zone is continually heated to remove excess moisture therefrom. In addition, since this portion of the paper includes this thermal energy, the rate of drying for the ink deposited is increased. It has been found that such a preheat zone reduces the amount of cockle and curl resulting from other known methods of heating.

When printing at eight pages per minutes, the printing sheets move at a speed of approximately one to five inches per second. At this speed, an operating temperature, that is the temperature generated by the heater 70 and received by the recording sheet, is preferably approximately 200 to 250 degrees Fahrenheit. The power supply 72 supplies between approximately 50 to 100 watts of power and is preferably supplying 75 watts of power at this particular temperature. Because of the relatively low surface temperatures required and generated, there is no concern of paper scorch that might occur with other known dryer designs. Consequently by providing a preheat zone, the recording mediums are preconditioned before entering the print zone for improved print drying.

Because PTC ceramic materials can be somewhat brittle, the ceramic heater is preferably supported from underneath as illustrated in FIG. 3. For instance, a wire basket 80 supports the heater 70 from underneath and is coupled to the inner guide 46 as well as to the existing platen 63. The support 80 is preferably a low mass member and is not too substantial such that the member 80 does not absorb excessive energy. One such material for the support would be aluminum. While the support 80 is illustrated as a basket having members 82 and 84 and 86 crisscrossing and forming a web-like structure, other possible support structures are also possible. For instance, it is possible that the heater 70 could have formed therein a recess running along the length of the heater into which a single center rail is inserted and which is attached at both ends thereof to the printing platen.

Figure 4:
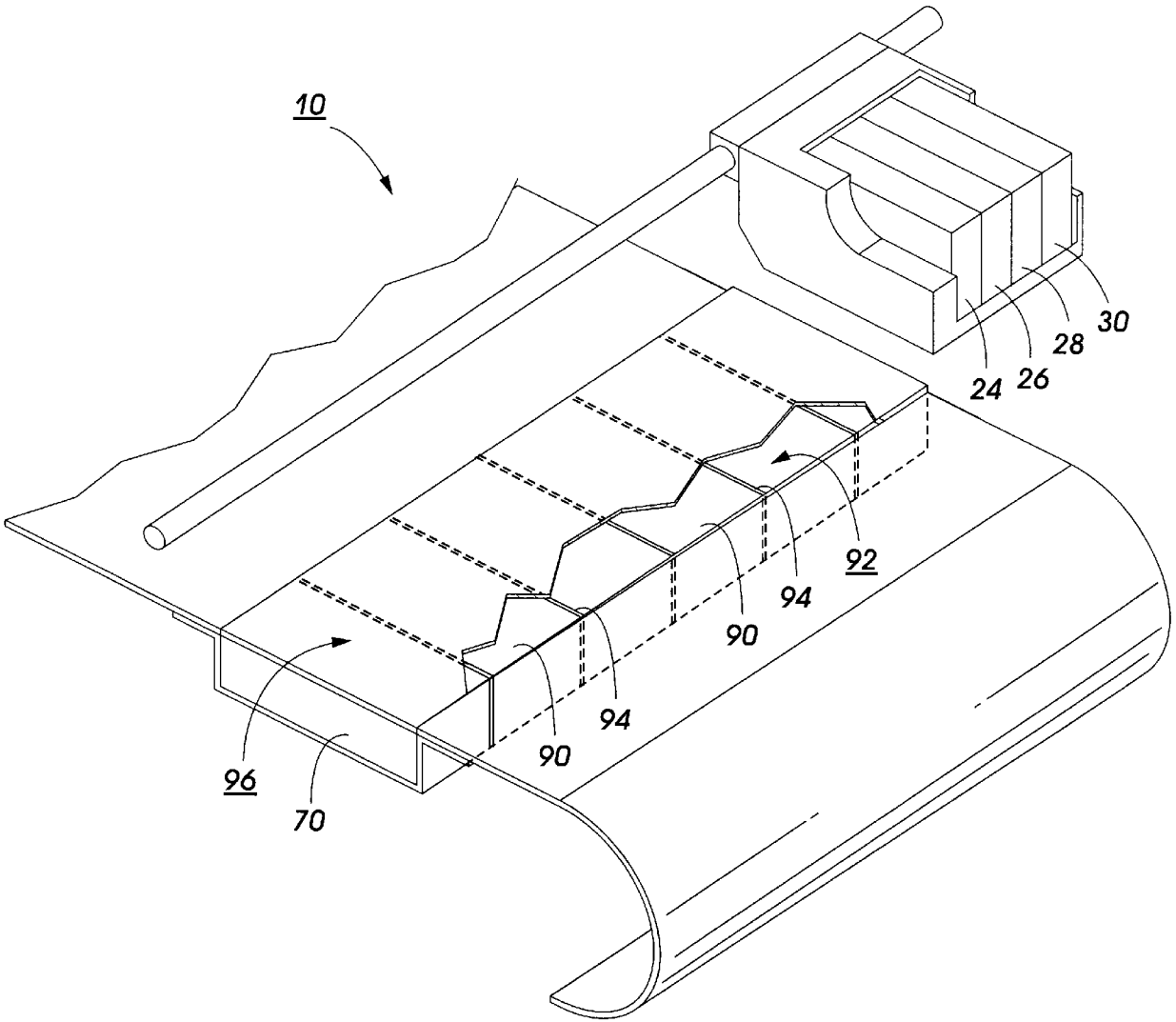
FIG. 4 illustrates a schematic elevational view of a second embodiment of a liquid ink printer having a self regulating contact dryer.

FIG. 4 illustrates another embodiment of the present invention including a segmented or multi-piece heater 70. The heater includes a plurality of elements 90, each of which is connected to an adjacent element by a connecting member which provides a conductive path for current to flow from one of the elements to the next. The multi-element heater 70 may be used in the place of a single element heater if it is found that a multiple element heater is less expensive to produce than a single element heater such as that described in FIGS. 1, 2 and 3. If a multi-element heater is used, however, the top surface of the heater 92 might include a plurality of depressions where the electrical connecting members have been located to provide for current flow. The presence of these depressions 94 can cause the overall surface of the heater 70 to be irregular such that a recording sheet passing over the top of such a heater might possibly be retarded in its passage thereover. It is contemplated, therefore, that the multi-element heater is covered with, or subtends, a covering member 96 which provides a substantially smooth and flat surface for the recording sheet to pass over. Such a material might include aluminum or any other known materials which are effective in transmitting heat energy from the heater 70 located therebeneath and which can be formed with a relatively smooth surface. It is also possible, that the heater 70 illustrated in FIGS. 1, 2 and 3 might include a similar covering portion such that the top surface of the heater 70 includes a relatively smooth surface, if it is found that a ceramic material cannot be formed to have a sufficiently smooth surface for the advance of the recording sheet.

It is, therefore, apparent that there has been provided in accordance with the present invention, a self regulating contact dryer for drying liquid ink deposited by a liquid ink printer which not only provides for heating portions of the recording medium located before the printzone and at the printzone, but which also maintains a relatively constant temperature regardless of the load. While this invention has been described in conjunction with a specific embodiment thereof, it is evident that many alternatives, modifications, and variations will be apparent to those skilled in the art. For instance, the present invention is not limited to the described thermal ink jet printer but is applicable to any printer depositing liquid ink on a recording medium. Accordingly, it is intended to embrace all such alternatives, modifications and variations that fall within the spirit and broad scope of the appended claims.

What is claimed is:

1. A liquid ink printer for depositing liquid ink to form an image on a recording medium moving along a path, comprising:

a printhead, disposed adjacent to the path, adapted to deposit ink on the recording medium in a print zone including a dimension being defined by the printhead; and a contact heater, directly in contact with the recording medium and disposed adjacently to the path substantially opposite said printhead along the path direction, including a positive temperature coefficient material, generating heat energy for heating the recording medium.

2. The liquid ink printer of claim 1, wherein said positive temperature coefficient material comprises a doped ceramic material.

3. The liquid ink printer of claim 2, wherein said positive temperature coefficient material is self-regulating.

4. The liquid ink printer of claim 1, wherein said contact heater includes a second dimension along the path direction being greater than the said first mentioned dimension.

5. The liquid ink printer of claim 4, wherein said second dimension is greater than approximately two times said first mentioned dimension.

6. The liquid ink printer of claim 5, wherein said second dimension is approximately two and one-half times said first mentioned dimension.

7. The liquid ink printer of claim 4, wherein said contact heater is disposed substantially opposite and before said printhead and includes a third dimension along the path direction being greater than said first mentioned dimension.

8. The liquid ink printer of claim 7, wherein said third dimension is approximately one and one-half times said first mentioned dimension.

9. The liquid ink printer of claim 1, wherein said printing machine comprises a roller transport means for moving the recording medium along the path at a predetermined rate of speed.

10. The liquid ink printer of claim 9, wherein said second dimension is selected as a function of said predetermined rate of speed for providing a dwell time for drying the liquid ink deposited on the recording medium.

11. The liquid ink printer of claim 10, wherein said dwell time is approximately five to forty-five seconds.

12. The liquid ink printer of claim 1, wherein said contact heater generates heat energy for causing the recording medium to be heated to a temperature of approximately 200 to 350 degrees Fahrenheit.

13. The liquid ink printer of claim 12, wherein said contact heater generates heat energy for causing the recording medium to be heated to a temperature of approximately 200 to 250 degrees Fahrenheit.

14. The liquid ink printer of claim 1, wherein said positive temperature coefficient material comprises a PTC paint.

15. The liquid ink printer of claim 1, wherein said contact heater is disposed along the path substantially opposite said printhead and before and after said printhead along the path direction.

* * * * *